United States Patent [19]

Hartevelt

[11] Patent Number: 4,965,996

[45] Date of Patent: Oct. 30, 1990

[54] POWER PLANT FOR BURNING A FUEL IN A FLUIDIZED BED

[75] Inventor: Peter D. Hartevelt, Finspong, Sweden

[73] Assignee: ABB Stal AB, Finspong, Sweden

[21] Appl. No.: 285,257

[22] Filed: Dec. 16, 1988

[30] Foreign Application Priority Data

Dec. 16, 1987 [SE] Sweden ..... 8705026

[51] Int. Cl.[5] ..... F02C 3/26

[52] U.S. Cl. ..... 60/39.464; 110/245; 209/305

[58] Field of Search ..... 60/39.464; 122/4 D; 110/245, 244, 263, 347; 431/7, 170; 165/104.16; 209/235, 258, 305, 372, 370

[56] References Cited

U.S. PATENT DOCUMENTS

| | | | |
|---|---|---|---|
| 1,458,434 | 6/1923 | Nickerson | 209/370 |
| 2,463,526 | 3/1949 | Dickson | 209/258 |
| 3,659,559 | 5/1972 | Foldes et al. | 122/4 D |
| 4,184,456 | 1/1980 | Taylor et al. | 110/245 |
| 4,259,911 | 4/1981 | Jones | 110/245 |
| 4,275,668 | 6/1981 | Daman | 110/245 |
| 4,343,246 | 8/1982 | Jukkola et al. | 110/106 |
| 4,357,883 | 11/1982 | Comparato et al. | 110/245 |
| 4,506,608 | 3/1985 | Strohmeyer, Jr. | 110/245 |
| 4,530,207 | 7/1985 | Brannstrom | 60/39.464 |
| 4,584,949 | 4/1986 | Brannstrom | 60/39.464 |

FOREIGN PATENT DOCUMENTS

| | | |
|---|---|---|
| 0139942 | 8/1984 | European Pat. Off. . |
| 3004846 | 11/1982 | Fed. Rep. of Germany . |
| 1600258 | 10/1981 | United Kingdom . |

*Primary Examiner*—Donald E. Stout

*Attorney, Agent, or Firm*—Pollock, Vande Sande & Priddy

[57] ABSTRACT

A power plant with a combustion chamber in which a fuel in burned in a fluidized bed of a particular material, comprises a storage container for the bed material which, upon a load reduction, is removed from the combustion chamber. The storage container is provided with a sieve or a grate which prevents slag lumps formed in the bed material from penetrating into a conduit for the return of the bed material to the combustion chamber. A tube projecting into the storage container forms the sieve.

5 Claims, 1 Drawing Sheet

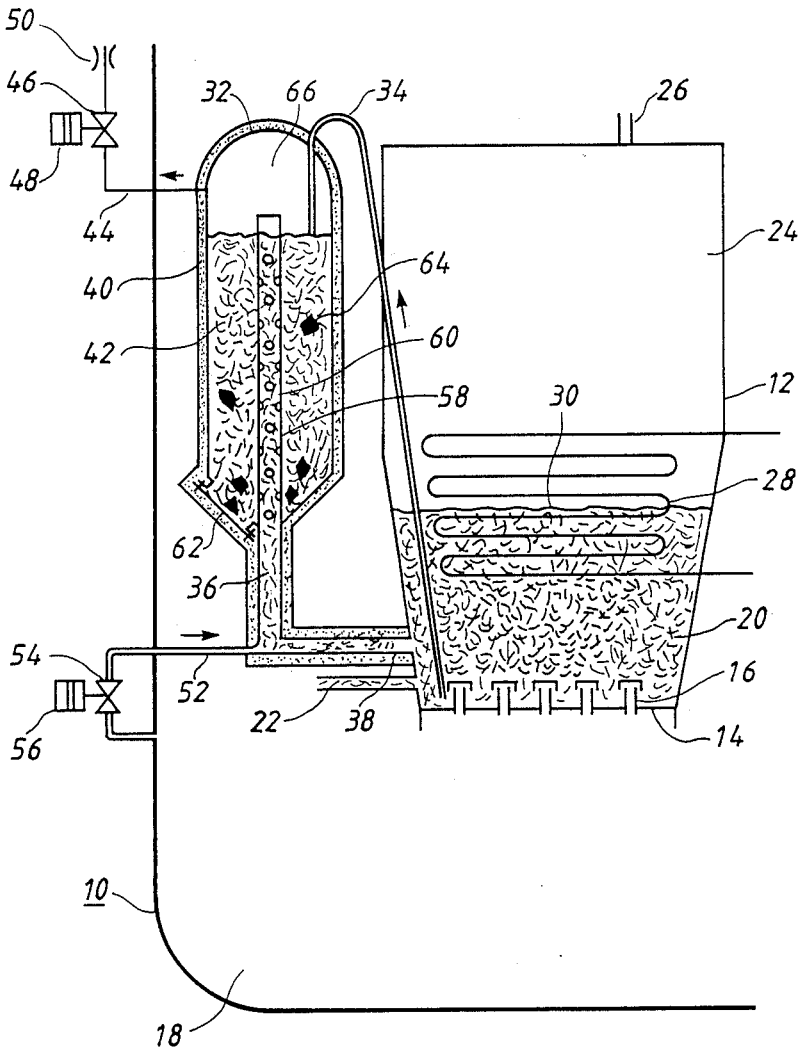
50
46
48
44
32
66
34
26
24
40
64
42
60
58
30
12
28
62
36
20
54
52
16
56
22
38
14
10
18

POWER PLANT FOR BURNING A FUEL IN A FLUIDIZED BED

TECHNICAL FIELD

The present invention relates to a power plant with a combustion chamber for burning a fuel in a fluidized bed of particulate material. The fuel is preferably coal and the bed material consists at least partly of a sulphur absorbent containing calcium, for example limestone or dolomite.

The invention can be applied to plants operating at atmospheric pressure as well as to plants operating at pressures considerably exceeding the atmospheric pressure. It is primarily intended for PFBC power plants with a combustion chamber enclosed within a pressure vessel and where the combustion gases are used for operation of gas turbines. (PFBC are the initial letters of the English expression Pressurized Fluidized Bed Combustion.)

BACKGROUND ART

European Patent No. 0 124 842 describes a PFBC power plant in which, for control of the power, hot bed material is transferred from the bed vessel to a storage container upon a power reduction and is returned to the bed vessel upon a subsequent power increase. Swedish patent application No. 8403162-4 describes a PFBC power plant with a storage container for a hot bed material which is utilized for ignition of the combustion chamber. In such storage containers, slag lumps may be formed which are of such a size that they may cause clogging of the return conduit and thus prevent the return of the bed material to the combustion chamber. The object of the invention is to design the plant in such a way as to eliminate the above-mentioned problems arising in connection with the return of bed material from the storage container.

SUMMARY OF THE INVENTION

According to the invention, the storage container is provided with a sieve or a grate preventing slag lumps from clogging the return conduit by forming a plug in the outlet or forming a bridge across the outlet. The sieve means is suitably designed as a tube projecting into the container and provided with a large number of apertures. The shape or cross section of the apertures is such as to prevent slag lumps, which may cause clogging of the discharge conduit, from reaching the outlet of the container. The apertures in the sieve means suitably have a smaller cross section than the outlet tube, preferably a considerably smaller cross section than the outlet tube.

The invention will be described in greater detail with reference to the accompanying schematic drawing, the single figure of which shows a relevant section of a PFBC power plant.

BRIEF DESCRIPTION OF THE DRAWING

In the figure, 10 designates a pressure vessel and 12 a combustion chamber enclosed within the pressure chamber 10 and having a bottom 14 with air nozzles 16. The combustion chamber 12 is surrounded by compressed air in the space 18 between the pressure vessel 10 and the combustion chamber 12. The air is received from a compressor (not shown). Air from the space 18 is supplied to the bed vessel 12 via the nozzles 16 and fluidizes a bed 20 of particulate material containing a sulphur absorbent and burns a fuel which is supplied to the bed 20 via a conduit 22. The combustion gases are collected in the freeboard 24 and are supplied to a gas turbine (not shown) via the conduit 26 which drives the compressor.

The combustion chamber 12 contains tubes 28 which cool the bed 20 and generate steam which drives a steam turbine (not shown). The height of the bed 20 varies with the load. At partial load, the bed height is lowered so that some of the tubes will be positioned above the bed surface 30. Upon a load reduction and lowering of the bed height, bed material is transferred to the storage container 32 via the conduit 34. The container 32 is connected to the lower part of the combustion chamber 12 by means of the return conduit 36 which is provided with a so-called L-valve 38. The container 32, the conduit 36 and the valve 38 are provided with a layer of a heat insulating material 40, which allows the bed material 42 to retain its temperature during storage. The container 32 is connected, via a conduit 44, to a valve 46 with an operating device 48. The valve 46 is located outside the pressure vessel 10. On the downstream side of the valve 46, a throttle means 50 may be arranged which determines the flow through an open valve 46. The L-valve 38 is connected to the space 18 in the pressure vessel 10 via the conduit 52 and the valve 54 with the operating device 56. The outlet tube 36 is connected to a sieve tube 58 with apertures 60. The sieve tube 58 may suitably have a smaller diameter than the return conduit 36. The container 32 is provided with a door 62. The bed material 42 may contain slag lumps 64.

The lowering of the bed level 30 upon a load reduction is brought about by opening the valve 46 so that gas from the space 66 in the container 32 flows out into the atmosphere and the pressure is reduced. By the pressure reduction in the space 66, a pressure difference is created between this space 66 and the bed vessel 12 and gas and bed material will flow from the bed vessel 12 to the container 32 via the conduit 34. Raising the bed level 30 upon a load increase is brought about by opening the valve 54. Air in the space 18, which has a higher pressure than gas at the orifice of the L-valve 38, activates the L-valve 38. This causes material in the container 32 to be returned to the bed. The sieve tube 58 prevents the slag lumps from blocking the outlet from the container 32 or from clogging the return conduit 36. When the container 32 is completely emptied, slag lumps 64 will accumulate at its lower part. When the plant is to be revised, these slag lumps 64 are removed through the door 62.

I claim:

1. A power plant with a combustion chamber for burning a fuel in a fluidized bed of particulate material comprising a storage container for receiving the bed material from the combustion chamber and for supplying the bed material to the combustion chamber upon changes in the load, the storage container including a sieve means extending within the storage container being in communication with a conduit for the return of the bed material from the storage container to the combustion chamber, said bed material being supplied to the return conduit through said sieve means, said sieve means being designed for preventing slag lumps formed in the bed material from penetrating into the return conduit.

2. A power plant according to claim 1 wherein said sieve means includes a perforated tube projecting into the storage container and connected to the return conduit of the storage container.

3. A power plant according to claim 1, wherein said sieve means includes a hollow member projecting upwardly into the storage container and provided with a plurality of openings in side walls thereof designed such as to prevent penetration of the slag lumps.

4. A power plant according to claim 1, wherein said sieve means comprises a perforated tube.

5. A power plant according to claim 1, wherein said sieve means is a tubular grate.

* * * * *